US009174815B2

(12) United States Patent
Lotz

(10) Patent No.: US 9,174,815 B2
(45) Date of Patent: Nov. 3, 2015

(54) CONTINUOUS PRINTER AND PAPER DELIVERY SYSTEM

(71) Applicant: LOTZ Industrial Printer Co., Zieglerville, PA (US)

(72) Inventor: Paul B. Lotz, Zieglerville, PA (US)

(73) Assignee: LOTZ INDUSTRIAL PRINTER CO., Zieglerville, PA (US)

( * ) Notice: Subject to any disclaimer, the term of this patent is extended or adjusted under 35 U.S.C. 154(b) by 0 days.

(21) Appl. No.: 14/172,936

(22) Filed: Feb. 5, 2014

(65) Prior Publication Data

US 2014/0217668 A1 Aug. 7, 2014

Related U.S. Application Data

(60) Provisional application No. 61/762,054, filed on Feb. 7, 2013.

(51) Int. Cl.
*B65H 5/02* (2006.01)
*B65H 7/02* (2006.01)

(52) U.S. Cl.
CPC ..... *B65H 7/02* (2013.01); *B65H 5/021* (2013.01); *B65H 2301/4473* (2013.01); *B65H 2404/2691* (2013.01); *B65H 2511/51* (2013.01); *B65H 2513/512* (2013.01); *B65H 2513/514* (2013.01); *B65H 2553/82* (2013.01); *B65H 2701/1311* (2013.01); *B65H 2701/1313* (2013.01); *B65H 2701/192* (2013.01); *B65H 2801/15* (2013.01)

(58) Field of Classification Search
CPC .. B65H 5/26; B65H 29/00; B65H 2404/2691; B65H 2301/4473; B65H 5/021
USPC ..... 271/3.14, 3.18, 9.01, 9.02, 9.04, 9.11, 271/9.13
See application file for complete search history.

(56) References Cited

U.S. PATENT DOCUMENTS

| | | | | |
|---|---|---|---|---|
| 6,608,988 | B2 * | 8/2003 | Conrow | 399/364 |
| 6,925,283 | B1 * | 8/2005 | Mandel et al. | 399/388 |
| 8,152,166 | B2 * | 4/2012 | Krucinski | 271/264 |

* cited by examiner

*Primary Examiner* — Michael McCullough
(74) *Attorney, Agent, or Firm* — Duane Morris LLP

(57) ABSTRACT

A printing and paper delivery system includes at least two printers disposed adjacent to one another. A first conveyor is coupled to a first printer of the at least two printers such that the first conveyer is configured to receive media output from an output chute of the first printer. A second conveyor is coupled to a second printer of the at least two printers such that the first conveyor is configured to receive media output from an output chute of the second printer. A controller is in signal communication with the first and second conveyors to facilitate the transfer of media from at least one of the at least two printers to a delivery location.

20 Claims, 3 Drawing Sheets

CONTINUOUS PRINTER AND PAPER DELIVERY SYSTEM

CROSS-REFERENCE TO RELATED APPLICATIONS

This application claims priority to U.S. Provisional Patent Application No. 61/762,054, filed Feb. 7, 2013, the entirety of which is incorporated by reference herein.

FIELD

The disclosed systems and methods generally relate to paper handling systems, and more particularly to a printer and paper delivery system.

BACKGROUND

The present invention generally relates to paper handling systems, and more particularly to a printer and paper delivery system.

Paper handling conveyor systems are used to transport individual thin sheets of paper for use in various types of commercial and industrial processes. Such conveyor systems generally include a moveable belt conveyor on which the paper travels and roller guides which engage and maintain contact between the sheets of paper and the belt. Since belt conveyors may transport the sheets of paper at relatively high speeds, the roller guides function to guide and provide positive feeding of the sheets of paper to various process delivery points.

One application for a paper transport belt conveyor systems is in the industrial printing and provision of individual paper labels. Industrial printing systems include one or more printers which print various indicia and/or images on a paper label, which may be provided with a water soluble dry adhesive backing in some embodiments. The individual labels may be of any size. After printing, the labels are fed one-by-one in serial fashion from the printer onto the belt conveyor for transport to a process delivery point where the label is affixed to various types of articles including without limitation large rolls of paper such as produced in a paper mill. Optimally, the labels are delivered to process delivery point with precise timing and placement to allow proper fixation to the article.

SUMMARY OF THE INVENTION

In some embodiments, a printing and paper delivery system includes at least two printers disposed adjacent to one another. A first conveyor is coupled to a first printer of the at least two printers such that the first conveyer is configured to receive media output from an output chute of the first printer. A second conveyor is coupled to a second printer of the at least two printers such that the first conveyor is configured to receive media output from an output chute of the second printer. A controller is in signal communication with the first and second conveyors to facilitate the transfer of media from at least one of the at least two printers to a delivery location.

In some embodiments, a printing and paper delivery system includes a plurality of printers, a plurality of conveyors, and a controller. The plurality of printers are disposed adjacent to one another to form an array. Each of the plurality of conveyors is coupled respectively to at least one of the plurality of printers. The controller is in signal communication with the first and second conveyors to facilitate the transfer of media from at least one of the at least two printers to a delivery location.

In some embodiments, a method includes receiving a first signal at a controller from a first sensor. The first signal identifies that media is located at a first location along a first conveyor. A second signal is transmitted from the controller to a first contact to activate a second conveyor in response to receiving the first signal. A third signal is received at the controller from a second sensor. The third signal identifies that the media is located at a first location along the second conveyor. The second conveyor is coupled to a second printer that is positioned adjacent to a first conveyor to which the first conveyor is coupled.

BRIEF DESCRIPTION OF THE DRAWINGS

The features of the preferred embodiments will be described with reference to the following drawings, where like elements are labeled similarly, and in which.

DETAILED DESCRIPTION OF EMBODIMENTS

Figure 1:
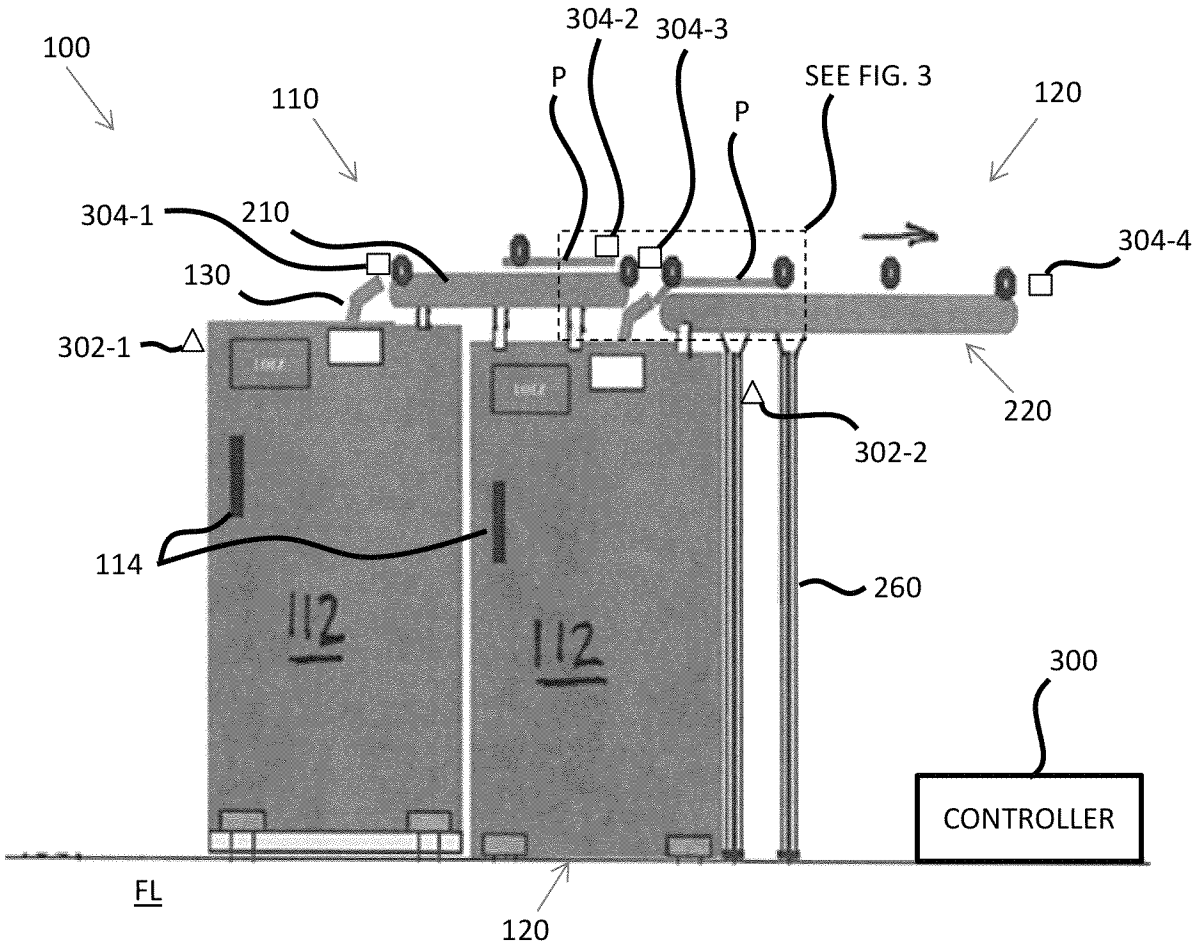
FIG. 1 is an elevation view of one embodiment of a printing and paper delivery system.

The features and benefits of the present disclosure are illustrated and described herein by reference to exemplary embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise.

A printing and paper delivery system and associated method are provided in one embodiment according to the present disclosure that includes a printer train or linear array comprising a plurality of printers (i.e., two or more) and a belt conveyor line interconnected to each of the printers. In some embodiments, the belt conveyor line includes of a series of individual belt conveyors placed in head to tail relationship along a common longitudinal axis. The belt conveyor line is configured to receive and transport, selectively, a sheet of paper such as a label from any of the available printers. Advantageously, the printing and paper handling system eliminates downtime if a single printer must be serviced and provides the flexibility to select the supply source for the single belt conveyor line from one of several different printers which may each hold different types of paper or labels (e.g. different color, printing, etc.) in some embodiments.

According to one embodiment, a printing and paper delivery system includes a belt conveyor line defining a longitudinal axis, and a plurality of printers axially aligned with the belt conveyor line in serial fashion. The printers are operative to dispense a sheet of paper onto the belt conveyor line. The belt conveyor line includes at least first and second belt conveyors, which are arranged in serial fashion along the longitudinal axis. In some embodiments, the first belt conveyor is located at a different elevation than the second belt conveyor.

As described in greater detail below, the disclosed systems and methods advantageously provide for an online backup/redundant printer and enables paper/labels of different types to be fed along a single conveyor line. Further, the number of printers placed in serial with one another can be extended to two or more with each printer in the series and each tray of each printer being individually addressable.

One example of a printing and paper delivery system 100 in accordance with some embodiments is now described, without limitation, with reference to a system as may be found in a paper mill. The principles and features of the system disclosed herein may be used with equal advantage for various commercial or industrial applications other than a paper mill. Accordingly, the present disclosure is not limited to any particular application of the system 100 described herein.

Figure 2:
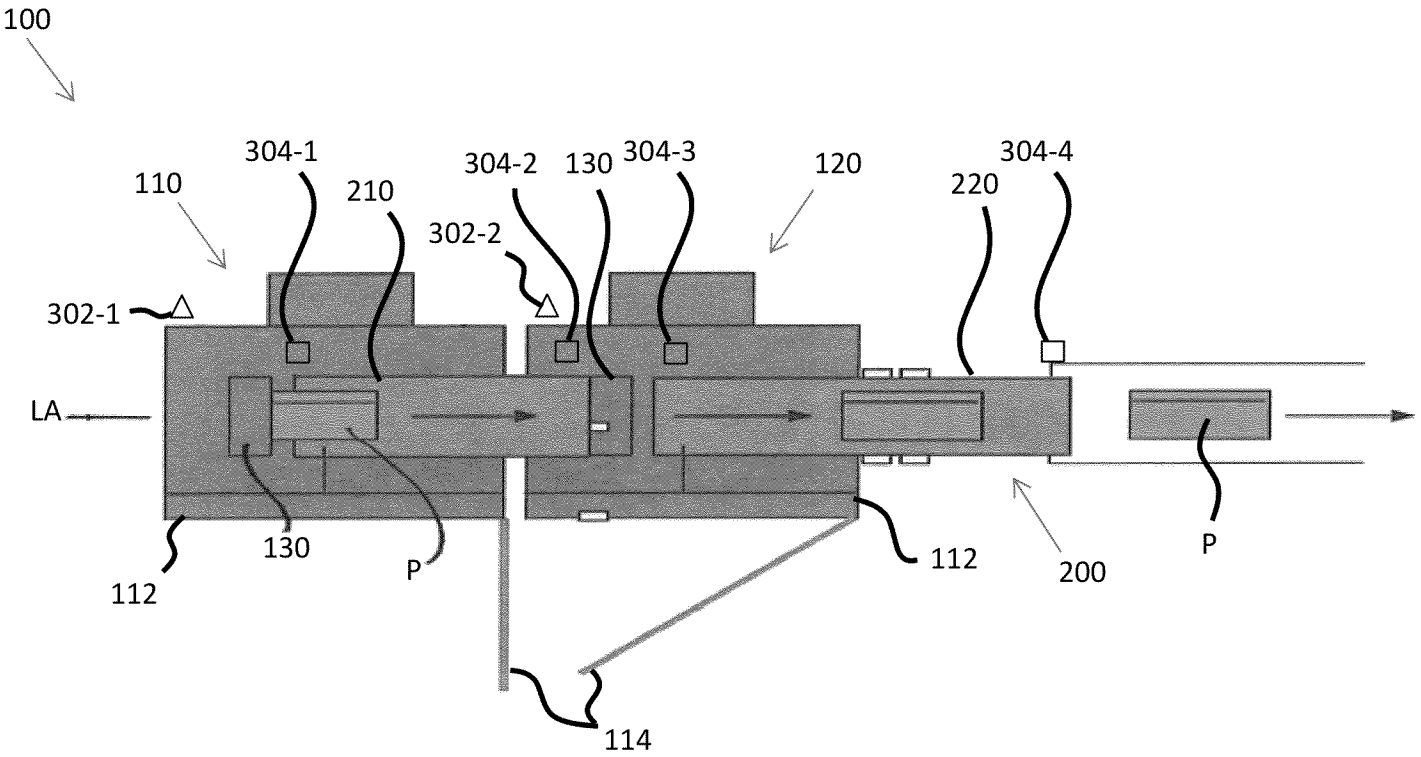
FIG. 2 is a top view thereof.

FIGS. 1 and 2 are side and top views, respectively, of one embodiment of a printing and paper delivery system 100 in accordance with some embodiments. The system generally includes a printer train and a belt conveyor line 200 interconnected to each of the printers. Belt conveyor line defines a longitudinal axis LA (see FIG. 2) which coincides with a paper process flow path. The printer train is comprised of at least a first printer 110 and a second printer 120. As noted above, although two printers 110, 120 are shown in FIGS. 1 and 2, additional printers can be included in a printing and paper delivery system in accordance with the present disclosure. Printers 110, 120 are arranged in end to end relationship along longitudinal axis LA as shown in FIG. 2. In some embodiments, the printers 110, 120 are each enclosed in a printer cabinet 112 to protect the printers from being contaminated by the ambient environment. The printer cabinet 112 includes a door 114 to allow access to the printer inside.

Each of the printers 110, 120 further includes an output chute 130 which dispenses a sheet of paper P through the printer cabinet 112 to the belt conveyor line. In one embodiment, the paper may be a label of any appropriate size including without limitation 8.5"×11" or 11"×17" to list only a few possibilities.

Figure 3:
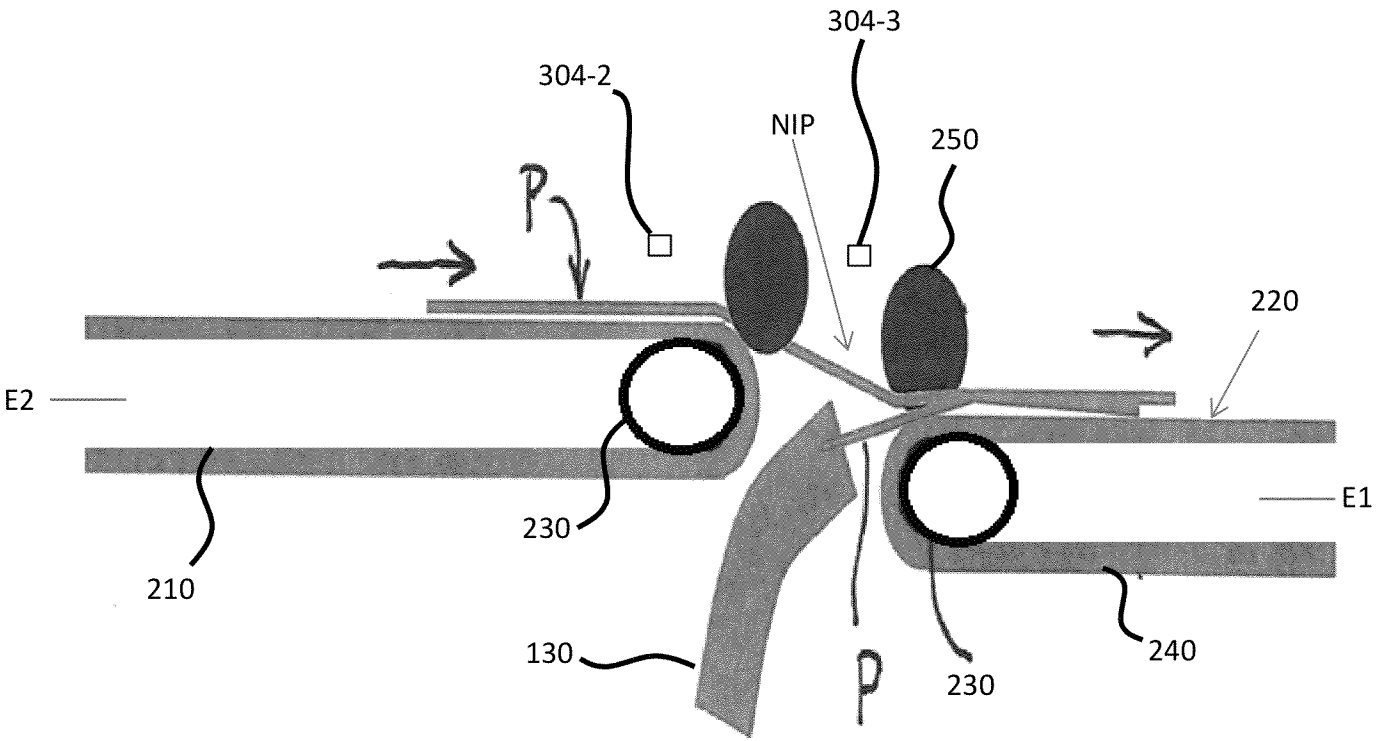
FIG. 3 is an enlarged detailed view of the junction between first and second belt conveyors shown in FIGS. 1 and 2.

With continuing reference to FIGS. 1 and 2, belt conveyor line 200 includes a plurality of individual belt conveyors 210, 220, which are arranged in head to tail but spaced apart relationship as shown along longitudinal axis LA. Belt conveyors 210, 220 are associated with printers 110, 120. Each of the belt conveyors 210, 220 includes pulleys 230, a continuous loop belt 240, and idler rollers 250 as best seen in FIG. 3. In some embodiments, without limitation, belt 240 may be made of any suitable commercially-available material including rubber, polymer or plastic, and other materials suitable for conveying paper. Belt conveyors 210, 220 further include roller guides 250 positioned at various locations to receive paper onto belts 240, guide the paper along the belts, and discharge paper P from the belts. Belt conveyor 220 terminates at a point corresponding to a process delivery point which may be an existing belt conveyor in the facility in some embodiments.

Each belt conveyor 210, 220 may be elevated above the printers 110, 120 and floor by suitable supports 260 attached to either the printer cabinet 112, and/or independently from the printers being mounted either on the floor of the facility (FL) and/or to existing available structural members or other equipment in the facility as variously shown in FIG. 1. The supports 260 may include vertical pillars of suitable length and configuration depending on where the belt conveyors 210, 220 are to be located. Any combination of supports types and mounting locations may be used, as applicable for a given installation, so long as the belt conveyors can be located at the proper position.

FIG. 3 is an enlarged detailed view of the junction between first and second belt conveyors shown in FIGS. 1 and 2. FIG. 3 shows an output chute 130 from printer 120 at the handoff point from the first belt conveyor 210 to the second belt conveyor 220 at the junction. Output chute 130 is angled upwards and forwards with respect to the horizontal plane defined by belt conveyor 220 in some embodiments. Chute 130 points towards belt conveyor 220 and in a forward leaning angle or direction along the path of travel of the conveyor (see directional arrows) to guide the paper P being dispensed at an upwards and forwards angle as shown.

With additional reference to FIG. 1, the belt conveyors 210, 220 may be vertically offset in some embodiments to provide space for the discharge chute 130 of printer 120 to dispense paper P between the belt conveyors. Accordingly, belt conveyor 210 may be located at located at an elevation E2 which is higher than elevation E1 of corresponding belt conveyor 220. In one embodiment, as best seen in FIG. 1, this may be produced by mounting printer 110 higher than printer 120 assuming each printer has the same height cabinet 112 and paper output chute 130. In other possible embodiments, printers 110,120 may be mounted at the same height on the floor and the output chute 130 of printer 110 may be modified to be longer and higher to reach conveyor 110. It will be appreciated that numerous printer mounting variations are possible so long as the belt conveyors 210 and 220 may be positioned at the proper elevations.

In some embodiments, for example, printer 110 is mounted to a floor FL approximately 4 inches higher than printer 120 to facilitate a smooth transition of paper P from belt conveyor 210 to belt conveyor 220. The leading edges of paper P from conveyor 210 and chute 130 of printer 120 enter a nip formed by belt 220 and its leading idle roller as identified by the arrow associated with NIP in FIG. 3.

In some embodiments, coordination between the printers 110, 120 is coordinated by a controller 300, such as a programmable logic controller ("PLC"), microprocessor, or other computing device, which is shown in FIG. 1. Although controller 300 is shown as being positioned separate from, and external to, printers 110, 120, one of ordinary skill in the art will understand that controller 300 can be included in one of the printer cabinets 112 or in a separate control cabinet (not shown). Controller 300 is coupled to one or more contacts 302-1, 302-2, etc. ("contacts 302"), which are configured to turn on motors (not shown) of a conveyor 210, 220. PLC also is coupled to sensors 304-1, 304-2, 304-3, 304-4, etc. ("304"), which are configured to detect when media, such as paper, passes by the sensor. One of ordinary skill in the art will understand that the illustrated of contacts 302 and sensors 304 are for discussion only and that contacts 302 and sensors 304 can be positioned in other locations other than those shown.

An exemplary method for operating the printing and paper delivery system 100 will now be briefly described with reference to FIGS. 1-3. In one possible operating backup printer operating scenario, without limitation, printer 120 is the primary printer and printer 110 is the secondary or backup redundant printer. In some embodiments, both printers 110, 120 supply the same type and design of media or paper P, which may be labels in one non-limiting example. Individual sheets of paper P are normally dispensed to belt conveyor line 200 from printer 120 via output chute 130. The paper P is inserted onto the head end of belt conveyor 220 between the two conveyors as shown in FIG. 3. Paper P is fed onto belt conveyor 220 beneath the idler roller 250.

If the normal sequence of paper supply from printer 120 is interrupted or needs to changed for any reason, backup paper supply is changed to printer 110, which dispenses paper through its output chute 130 onto the head end of belt conveyor 210. The paper P travels on belt conveyor 210 until it reaches the tail end of the belt conveyor 220. At this point, the paper P leaves belt conveyor 210 and is fed onto the head end of belt conveyor 220 as best shown in FIG. 3. Belt conveyor 210 is oriented and positioned to feed paper beneath idler roller 250 on belt conveyor 220 as shown and in a similar position as paper feed to belt conveyor 220 from printer 120.

More particularly, in embodiments in which printer 110 is configured as a backup printer, media (e.g., paper P) emerges from output chute 130 of printer 110 and sensor 304-1 communicates the emergence to controller 300 requesting controller 300 to turn on conveyor 210. In other embodiments, printer 110 may print different colors or types of labels than printer 120. Accordingly, printer 110 may be used as an alternate, and not necessarily backup source of paper or label supply to belt conveyor line 200. In response to the signal received from sensor 304-1, controller 300 actuates contact 302-1, which turns on conveyor 210. When the media arrives at, and is sensed by, sensor 304-3, sensor 304-3 communicates the arrival of the media to controller 300. In response, PLC 300 turns on conveyor 220 by communicating a signal to contact 302-2. PLC 300 turns on conveyor 220 for a time that is sufficient for the media (e.g., paper P) to arrive at the pick-up point, which can be sensed by sensor 304-4.

In some embodiments, printer 110 is configured to print and hold a second piece of media, such as a label identified as paper P, for use as a second bilge label. In such embodiments, the process described above is used to transfer the second label to sensor 304-2 where the label is stopped. Label is stopped by sensor 304-2 transmitting a signal to controller 300, which transmits a signal to contact 302-1 to turn off conveyor 210. When the label (paper P) is needed, controller 300 receives a signal requesting the label and in response transmits a signal to contact 302-1 to turn on conveyor 210. The label is carried by conveyor 210 and transferred along conveyor 210 until the paper is sensed by sensor 304-3. Sensor 304-3 sends a signal to controller 300 indicating that sensor 304-3 has sensed paper P. In response, controller 300 transmits a signal to contact 304-2 to turn on conveyor 220 to effectuate the transfer from conveyor 210 to conveyor 220. The paper is transferred along conveyor 220 until it reaches the terminal point where it is sensed by sensor 304-4. PLC 300 receives a signal from sensor 302-4 indicating the arrival of the paper P and controller 300 transmits a signal to contact 302-2 to turn off conveyor 220 in response.

In some embodiments, such as embodiments when printer 120 is configured as the main or primary printer and is fully operational, media or paper P emerges from exit chute 130 of printer 120 where it is sensed by sensor 304-3. In response to sensing paper at sensor 304-3, a signal is transmitted from sensor 304-3 to controller 300. In response to receiving the signal from sensor 304-3, controller 300 transmits a signal to contact 302-2 to turn on conveyor 220. The paper is transferred along conveyor 220 until it reaches the terminal point where it is sensed by sensor 304-4. Controller 300 receives a signal from sensor 302-4 indicating the arrival of the paper P and controller 300 transmits a signal to contact 302-2 to turn off conveyor 220 in response.

As noted above, embodiments of a printing and paper delivery system according to the present disclosure may use any number of printers in a train (e.g., a linear array) as may be used as required for a given installation. To facilitate the operation of the printers in the linear array, a controller (such as a PLC, microprocessor, or other computing device) is configured to receive signals from sensors 304 and transmit signals to contacts 302. Further, the controller can be configured to address each printer and each media tray of each printer individually. The disclosed systems and methods advantageously eliminates downtime if a single printer must be serviced and provides the flexibility to select the supply source for the single belt conveyor line from one of several different printers which may each hold different types of paper or labels (e.g. different color, printing, etc.) in some embodiments.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A printing and paper delivery system, comprising:

at least two printers disposed adjacent to one another, wherein each of the at least two printers is located in a respective printer cabinet;

a first conveyor coupled to a first printer of the at least two printers such that the first conveyer is configured to receive first media output from an output chute of the first printer and to move the first media in a first direction along an upper surface of the first conveyor, wherein the first conveyor is spaced above and extends at least partially over the respective printer cabinets of the first printer and the second printer;

a second conveyor coupled to a second printer of the at least two printers such that the second conveyor is positioned adjacent to and spaced apart from the first conveyor in the first direction, the second conveyor configured to receive second media output from an output chute of the second printer, receive the first media from the first conveyor, and move the first and second media along an upper surface of the second conveyor in the first direction, wherein the second conveyor is spaced above the printer cabinet of the second printer; and a controller in signal communication with the first and second conveyors to facilitate the transfer of media from at least one of the at least two printers to a delivery location.

2. The printing and paper delivery system of claim 1, wherein the controller includes a programmable logic controller.

3. The printing and paper delivery system of claim 1, wherein the controller includes a microprocessor.

4. The printing and paper delivery system of claim 1, wherein the controller is configured to receive signals from a plurality of sensors disposed at various positions along the first conveyor and the second conveyor.

5. The printing and paper delivery system of claim 4, wherein the controller is configured to turn on and off the first and second conveyors, selectively, in response to signals received from the plurality of sensors.

6. The printing and paper delivery system of claim 1, wherein the upper surface of the first conveyor is disposed at a first elevation and the upper surface of the second conveyor is disposed at a second elevation.

7. The printing and paper delivery system of claim 6, wherein the first elevation is different from the second elevation.

8. A printing and paper delivery system, comprising:

a plurality of printers disposed adjacent to one another to form an array, each printer in communication with a respective output chute, and wherein each of the plurality of printers is located in a respective cabinet;

a plurality of conveyers, each of the plurality of conveyors respectively coupled to an upper surface of at least one of the plurality of printers, each conveyor configured to receive media output from the output chute of the respective printer to which the conveyor is coupled and move the media in a first direction; and a controller in signal communication with each of the plurality of conveyors to facilitate the transfer of media from at least one of the plurality of printers to a single delivery location, wherein each of the plurality of conveyors is disposed adjacent to and spaced apart from at least one other conveyor in the first direction such that each conveyor is configured to at least one of directly receive media from another conveyor and directly transfer media to another conveyor, and wherein each of the plurality of conveyors is disposed above and extends at least partially over the respective printer cabinets of at least two of the plurality of printers.

9. The printing and paper delivery system of claim 8, wherein the controller includes a programmable logic controller.

10. The printing and paper delivery system of claim 8, wherein the controller includes a microprocessor.

11. The printing and paper delivery system of claim 8, wherein the controller is configured to receive signals from a plurality of sensors disposed at various positions along the plurality of conveyors.

12. The printing and paper delivery system of claim 11, wherein the controller is configured to turn on and off the plurality of conveyors, selectively, in response to signals received from the plurality of sensors.

13. The printing and paper delivery system of claim 8, wherein an upper surface of a first conveyor of the plurality of conveyors is disposed at a first elevation and an upper surface of a second conveyor of the plurality of conveyors that is positioned directly adjacent to the first conveyor is disposed at a second elevation.

14. The printing and paper delivery system of claim 13, wherein the first elevation is different from the second elevation.

15. A method, comprising:

receiving a first signal at a controller from a first sensor, the first signal identifying that media is located at a first location along a first conveyor;

transmitting a second signal from the controller to a first contact to activate a second conveyor in response to receiving the first signal, wherein the second conveyor is spaced apart from the first conveyor;

receiving a third signal at the controller from a second sensor, the third signal identifying one of media transmitted by the first conveyor is located at a first location along the second conveyor and media being output from an output chute positioned between an end of the first conveyor and an end of the second conveyor is located at the first location along the second conveyor, wherein the second conveyor is coupled to a second printer that is positioned adjacent to a first printer to which the first conveyor is coupled, wherein the first printer is located in a first printer cabinet and the second printer is located in a second printer cabinet, and wherein the first conveyor and the second conveyor are external to and spaced apart from the first and second printer cabinets.

16. The method of claim 15, further comprising:

receiving a fourth signal at the controller from a third sensor, the fourth signal identifying that media is located at a second location along the first conveyor; and transmitting a fifth signal from the controller to a second contact to activate the first conveyor in response to receiving the first signal to transfer media from the second location along the first conveyor to the first location along the first conveyor.

17. The method of claim 15, wherein an upper surface of the first conveyor is disposed at a first elevation and an upper surface of the second conveyor is disposed at a second elevation.

18. The method of claim 17, wherein the first elevation is different from the second elevation.

19. The method of claim 15, wherein the controller includes a programmable logic controller.

20. The method of claim 15, wherein the controller includes a microprocessor.

* * * * *